US010297185B2

(12) United States Patent
Choi et al.

(10) Patent No.: US 10,297,185 B2
(45) Date of Patent: May 21, 2019

(54) CONTROLLER, SOURCE DRIVER IC, DISPLAY DEVICE, AND SIGNAL TRANSMISSION METHOD THEREOF

(71) Applicant: LG DISPLAY CO., LTD., Seoul (KR)

(72) Inventors: Hyunll Choi, Paju-si (KR); SockJong Yoo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 214 days.

(21) Appl. No.: 14/855,285

(22) Filed: Sep. 15, 2015

(65) Prior Publication Data

US 2016/0189595 A1 Jun. 30, 2016

(30) Foreign Application Priority Data

Dec. 24, 2014 (KR) ..... 10-2014-0188280

(51) Int. Cl.

| | |
|---|---|
| ***G09G 3/36*** | (2006.01) |
| ***G09G 3/20*** | (2006.01) |
| ***G09G 3/3275*** | (2016.01) |
| ***G09G 3/3258*** | (2016.01) |
| ***G09G 3/3291*** | (2016.01) |

(52) U.S. Cl.

CPC ..... *G09G 3/2018* (2013.01); *G09G 3/2074* (2013.01); *G09G 3/2092* (2013.01); *G09G 3/2096* (2013.01); *G09G 3/3258* (2013.01); *G09G 3/3275* (2013.01); *G09G 3/3291* (2013.01); *G09G 2300/0426* (2013.01); *G09G 2300/0861* (2013.01); *G09G 2310/0275* (2013.01); *G09G 2310/08* (2013.01); *G09G 2320/029* (2013.01); *G09G 2320/045* (2013.01);

(Continued)

(58) Field of Classification Search

CPC .. G09G 3/2018; G09G 3/2074; G09G 3/2096; G09G 3/3258; G09G 3/3291; G09G 2300/0861; G09G 2310/0275; G09G 2310/08; G09G 2320/029; G09G 2320/045; G09G 2330/06; G09G 2370/08; G09G 2370/14

USPC ..... 345/76, 98–100, 204

See application file for complete search history.

(56) References Cited

U.S. PATENT DOCUMENTS

2010/0156885 A1* 6/2010 Cho ..... G09G 3/006 345/214
2013/0050292 A1* 2/2013 Mizukoshi ..... G09G 3/3291 345/690

(Continued)

FOREIGN PATENT DOCUMENTS

CN 101853624 A 10/2010
CN 105590584 A 5/2016

(Continued)

OTHER PUBLICATIONS

European Extended Search Report, European Application No. 15201961.8, dated Oct. 19, 2016, 20 pages.

(Continued)

*Primary Examiner* — Jennifer T Nguyen
(74) *Attorney, Agent, or Firm* — Fenwick & West LLP

(57) ABSTRACT

A controller, a source driver integrated circuit (IC), a display device, and a signal transmission method thereof. When data is received from the source driver integrated circuit and the received data is recognized, data recognition errors that would otherwise be caused by an asynchronous state between an internal clock and data can be prevented.

9 Claims, 12 Drawing Sheets

(52) U.S. Cl.
CPC ..... *G09G 2330/06* (2013.01); *G09G 2370/08* (2013.01); *G09G 2370/14* (2013.01)

(56) References Cited

U.S. PATENT DOCUMENTS

| | | | | |
|---|---|---|---|---|
| 2013/0050302 | A1* | 2/2013 | Su | G09G 3/20 345/691 |
| 2013/0093652 | A1 | 4/2013 | Kim et al. | |
| 2013/0113777 | A1 | 5/2013 | Baek et al. | |
| 2013/0147693 | A1 | 6/2013 | Bae | |
| 2016/0125840 | A1* | 5/2016 | Oh, II | G09G 5/006 345/213 |

FOREIGN PATENT DOCUMENTS

| | | | |
|---|---|---|---|
| JP | 2014-119750 | A | 6/2014 |
| KR | 2009-0052664 | A | 5/2009 |
| TW | 201222524 | A1 | 6/2012 |

OTHER PUBLICATIONS

Nam, H. et al., "A Cost-Effective 60Hz FHD LCD Using 800Mbps AiPi Technology," Journal of Information Display, Mar. 2009, pp. 37-44, vol. 10, No. 1.
European Partial Search Report, European Application No. 15201961.8, dated Jul. 15, 2016, 10 pages.
Chinese First Office Action, Chinese Application No. 201510671788.3, dated Mar. 5, 2018, 21 pages.

* cited by examiner

CONTROLLER, SOURCE DRIVER IC, DISPLAY DEVICE, AND SIGNAL TRANSMISSION METHOD THEREOF

CROSS REFERENCE TO RELATED APPLICATION

This application claims priority from and the benefit under 35 U.S.C. § 119(a) of Korean Patent Application Number 10-2014-0188280 filed on Dec. 24, 2014, which is hereby incorporated by reference for all purposes as if fully set forth herein.

BACKGROUND

Related Field

The present disclosure relates to a controller, a source driver integrated circuit (IC), a display device, and a signal transmission method thereof.

Description of Related Art

Following the growth of the information society, there is increasing demand for various types of display device able to display images. Recently, various display devices, such as liquid crystal displays (LCDs), plasma display panels (PDPs), and organic light-emitting diode (OLED) displays, are used.

Such a display device includes: a display panel on which data lines and gate lines are disposed and subpixels are disposed in the shape of a matrix at points where the data lines intersect the gate lines; a data driver supplying data signals to the data lines; a gate driver supplying scanning signals to the gate lines; and a timing controller controlling the data driver and the gate driver.

The timing controller performs the operation of receiving corresponding data from one or a plurality of source driver ICs of the data driver and recognizing the received data in order to perform a specific process (e.g. a compensation process).

When the timing controller recognizes the data received from the source driver IC(s) using the internal clock thereof, the timing controller may not accurately recognize the data if the data is asynchronous to the internal clock.

BRIEF SUMMARY

A display device and a signal transmission method thereof able to prevent data recognition errors that would otherwise be caused by an asynchronous state between an internal clock and data when receiving the data from a source driver IC and recognizing the received data are disclosed.

In one aspect, a display device includes: a display panel on which a plurality of subpixels are disposed; a timing controller configured to transmit an internal clock on a lock signal; and a plurality of source driver ICs configured to transmit data synchronized to the internal clock to the timing controller in response to receiving the lock signal carrying the internal clock.

In another aspect, a controller includes: a lock signal transceiver transmitting and receiving an internal clock on a lock signal; and a data receiver receiving data synchronized to the internal clock.

In another aspect, a source driver IC includes: a lock signal transceiver configured to receive a lock signal carrying an internal clock, and to output the lock signal; and a data transceiver configured to transmit data synchronized to the internal clock carried on the lock signal.

In another aspect, provided is a signal transmission method of a display device including a display panel on which data lines and gate lines are disposed, a source driver IC driving the data lines, and a timing controller controlling the source driver IC. The method includes: transmitting, at the timing controller, an internal clock on a lock signal; transmitting, at the source driver IC, data to the timing controller by synchronizing the data to the internal clock carried on the lock signal; and receiving, at the timing controller, the lock signal carrying the internal clock and the data, and recognizing the received data by synchronizing the received data to the internal clock carried on the received lock signal.

According to the embodiments as set forth above, it is possible to provide the controller, the source driver IC, the display device, and the signal transmission method thereof able to prevent data recognition errors that would otherwise be caused by an asynchronous state between an internal clock and data when receiving the data from the source driver IC and recognizing the received data.

BRIEF DESCRIPTION OF THE DRAWINGS

The above and other objects, features and advantages of the various embodiments will be more clearly understood from the following detailed description when taken in conjunction with the accompanying drawings, in which.

DETAILED DESCRIPTION

Figure 1:
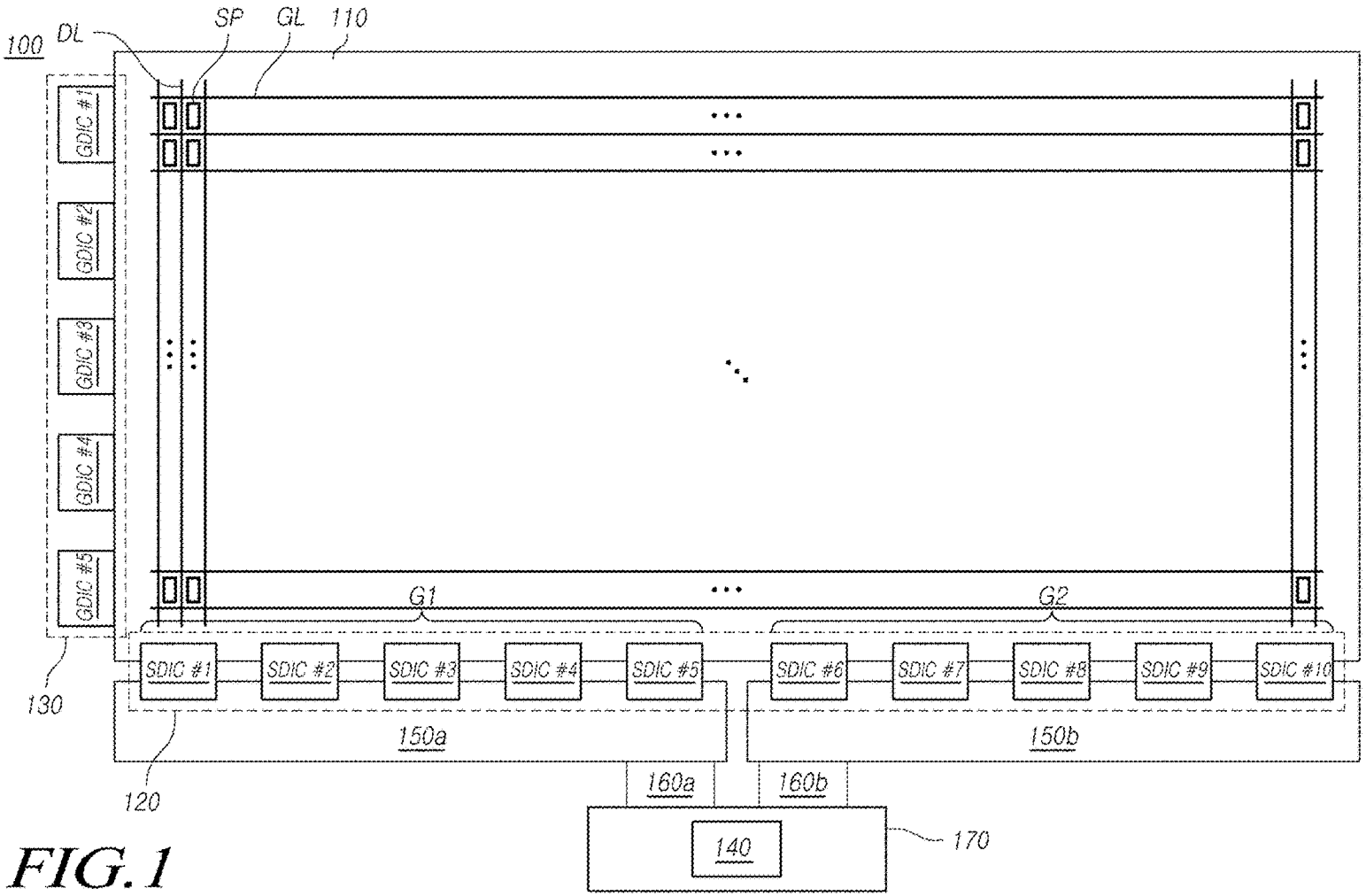
FIG. 1 is a schematic diagram illustrating an exemplary system configuration of a display device according to embodiments.

Reference will now be made in detail to various embodiments of which are illustrated in the accompanying drawings. Throughout this document, reference should be made to the drawings, in which the same reference numerals and signs may be used throughout the different drawings to designate the same or similar components. In the following description, detailed descriptions of known functions and components incorporated herein will be omitted in the case that the subject matter may be rendered unclear thereby.

It will also be understood that, although terms such as "first," "second," "A," "B," "(a)" and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected" or "coupled to" the other element, but also can it be "indirectly connected or coupled to" the other element via an "intervening" element. In the same context, it will be understood that when an element is referred to as being formed "on" or "under" another element, not only can it be directly formed on or under another element, but also can it be indirectly formed on or under another element via an intervening element.

FIG. 1 is a schematic diagram illustrating an exemplary system configuration of a display device 100 according to one or more embodiments.

Referring to FIG. 1, the display device 100 according to embodiments includes a display panel 110, a data driver 120, a gate driver 130, and a timing controller 140.

On the display panel 110, data lines DL are disposed in a first direction, gate lines GL are disposed in a second direction crossing the first direction, and subpixels SP are disposed in the shape of a matrix. The data driver 120 drives the data lines by supplying data voltages to the data lines. The gate driver 130 sequentially drives the gate lines by sequentially supplying gate voltages to the gate lines. The timing controller 140 controls the data driver 120 and the gate driver 130 by supplying control signals to the data driver 120 and the gate driver 130.

The timing controller 140 starts scanning based on the timing set in each frame, converts image data input from an external source (e.g. a host system (not shown)) according to a data signal format used by the data driver 120, outputs the converted image data, and regulates data driving at an appropriate point of time according to the scanning.

The gate driver 130 sequentially drives the gate lines by sequentially supplying an on-voltage signal or an off-voltage signal to the gate lines under the control of the timing controller 140.

As illustrated in FIG. 1, the gate driver 130 is positioned on one side of the display panel 110. In some cases, the gate driver 130 may be divided into two sections positioned on opposite sides of the display panel 110.

In addition, the gate driver 130 includes a plurality of gate driver integrated circuits (gate driver ICs).

Referring to FIG. 1, the gate driver 130 was illustrated as including five gate driver ICs GDIC #1 to GDIC #5. Alternatively, the gate driver 130 may include one gate driver IC or may include two or more gate driver ICs. In the following description, for the sake of explanation, it will be assumed that the display device 100 includes five gate driver ICs GDIC #1 to GDIC #5.

In addition, the gate driver ICs GDIC #1 to GDIC #5 of the gate driver 130 may be connected to the bonding pads of the display panel 110 by a tape automated bonding (TAB) method or a chip on glass (COG) method, or may be implemented as a gate-in-panel (GIP) type circuit directly disposed on the display panel 110. In some cases, each of the gate driver ICs GDIC #1 to GDIC #5 may be integrated with the display panel 110.

Each of the gate driver ICs GDIC #1 to GDIC #5 includes a shift register, a level shifter, an output buffer, and the like.

When a specific gate line is opened, the data driver 120 drives the data lines by converting image data received from the timing controller 140 to analog data voltages and supplying the analog data voltages to the data lines.

The data driver 120 includes one or more source driver ICs (also referred to as "data driver ICs").

Referring to FIG. 1, the data driver 120 was illustrated as including ten source driver ICs SDIC #1 to SDIC #10. Alternatively, the data driver 120 may include one source driver IC or may include two or more source driver ICs. In the following description, for the sake of explanation, it will be assumed that the display device 100 includes ten source driver ICs SDIC #1 to SDIC #10.

The source driver ICs SDIC #1 to SDIC #10 of the data driver 120 may be connected to the bonding pads of the display panel 110 by a tape automated bonding (TAB) method or a chip on glass (COG) method, or may be implemented as a gate-in-panel (GIP) type circuit directly disposed on the display panel 110. In some cases, each of the source driver ICs SDIC #1 to SDIC #10 may be integrated with the display panel 110.

Each of the source driver ICs SDIC #1 to SDIC #10 includes a shift register, a latch, a digital-to-analog converter (DAC), an output buffer, and the like. In some cases, each source driver IC may further include an analog-to-digital converter (ADC) functioning for subpixel compensation. The ADC senses an analog voltage value, converts the analog voltage value to a digital voltage value, and outputs the digital voltage value.

In addition, each of the source driver ICs SDIC #1 to SDIC #8 may be embodied by a chip-on-bonding (COB) method. In each of the source driver ICs SDIC #1 to SDIC #10, one end is bonded to at least a source printed circuit board (PCB) 160, and the other end is bonded to the display panel 110.

The source PCB may be a single source PCB, may be divided into two group source PCBs 150*a* and 150*b* as in FIG. 1, or may be divided into three or more group source PCBs. In the following, for the sake of explanation, it will be assumed that the display device 100 includes two group source PCBs 150*a* and 150*b*.

The source driver ICs SDIC #1 to SDIC #10 of the data driver 120 may be included in the same group or may be divided into several groups.

In the following, it will be assumed that the first five source driver ICs SDIC #1 to SDIC #5 from the left belong to a first group G1 and the remaining five source driver ICs SDIC #6 to SDIC #10 belong to a second group G2.

The source driver ICs belonging to each group transmit to and receive from the timing controller 140 signals and data through a single wiring structure.

Accordingly, the display device 100 according to one or more embodiments includes a first group wiring structure through which the source driver ICs SDIC #1 to SDIC #5 belonging to the first group transmit to and receive from the timing controller 140 signals and data, and a second group wiring structure through which the source driver ICs SDIC #6 to SDIC #10 belonging to the second group transmit to and receive from the timing controller 140 signals and data.

In this regard, the first group wiring structure includes the first group source PCB 150*a* to which the source driver ICs SDIC #1 to SDIC #5 of the first group G1 are bonded and a first group connection medium 160*a* through which the first group source PCB 150*a* is connected to a control PCB 170 on which the timing controller 140 is disposed.

In addition, the second group wiring structure includes the second group source PCB 150*b* to which the source driver ICs SDIC #6 to SDIC #10 of the second group G2 are bonded and a second group connection medium 160*b* through which the second group source PCB 150*b* is connected to a control PCB 170 on which the timing controller 140 is disposed.

The first group connection medium 160*a* and the second group connection medium 160*b* stated above may be implemented as, for example, a flexible flat cable (FFC) or a flexible printed circuit (FPC).

The timing controller 140 receives image data of an incoming input image and a variety of timing signals from an external host system (not shown). The variety of timing signals may include a vertical synchronization signal Vsync, a horizontal synchronization signal Hsync, an input data enable signal DE, a clock signal CLK, or the like.

The timing controller 140 receives the timing signals, such as the vertical synchronization signal, the horizontal synchronization signal, the input data enable signal, and the clock signal, generates a variety of control signals, and outputs the control signals to the data driver 120 and the gate driver 130 in order to control the data driver 120 and the gate driver 130, in addition to outputting converted image data produced by converting incoming image data input from the host system into the data signal format used in the data driver 120.

For example, the timing controller 140 outputs a variety of gate control signals (GCSs) including a gate start pulse (GSP), a gate shift clock (GSC), and a gate output enable signal (GOE) in order to control the gate driver 130. The gate start pulse controls the operation start timing of the one or more gate driver ICs GDIC #1 to GDIC #5 of the gate driver 130. The gate shift clock is a clock signal commonly input to the one or more gate driver ICs GDIC #1 to GDIC #5, and controls the shift timing of the scanning signal (gate pulse). The gate output enable signal designates the timing information of the one or more gate driver ICs GDIC #1 to GDIC #5.

The timing controller 140 outputs a variety of data control signals (DCSs) including a source start pulse (SSP), a source sampling clock (SSC) and a source output enable signal (SOE) in order to control the data driver 120. The source start pulse controls the data sampling start timing of the one or more source driver ICs SDIC #1 to SDIC #8 of the data driver 120. The source sampling clock is a clock signal to control the data sampling timing of each of the source driver ICs SDIC #1 to SDIC #10. The source output enable signal controls the output timing of the data driver 120. In some cases, the data control signals may further include a polarity control signal (POL).

Referring to FIG. 1, a power controller (not shown) is further disposed on the control PCB 170. The power controller (not shown) supplies a variety of voltages or currents to the display panel 110, the data driver 120, the gate driver 130, and the like, or controls the variety of voltages or currents to be supplied to the display panel 110, the data driver 120, the gate driver 130, and the like. The power controller is also referred to as the power management IC (PMIC).

The display device 100 schematically illustrated in FIG. 1 may be one selected from among, but not be limited to, a liquid crystal display (LCD), a plasma display device, and an organic light-emitting diode (OLED) display.

Circuit devices, such as a transistor and a capacitor, are formed on each of the subpixels SP disposed on the display panel 110. For example, when the display panel 110 is an OLED panel, a circuit including an OLED, two or more transistors, and one or more capacitors is formed on each of the subpixels.

A description of the structure of a subpixel circuit will be given below assuming the display panel 110 is an OLED panel.

Each of the subpixels SP disposed on the display panel 110 according to embodiments includes an OLED and a driving circuit.

The driving circuit includes a driving transistor (DRT) driving the OLED, a switching transistor (SWT) applying a data voltage to a gate node of the driving transistor when a corresponding row is selected by a scanning signal, and a storage capacitor (Cstg) maintaining the data voltage for a period of a single frame.

That is, each subpixel of the display panel 110 implemented as an OLED panel includes two transistors (DRT, SWT) and a single capacitor (Cstg). One or more additional transistors or one or more additional capacitors may be added.

The driving transistor (DRT) in each subpixel has unique characteristics, such as a threshold voltage (Vth) and mobility.

The driving transistor (DRT) degrades throughout its usage, thus the characteristics, such as the threshold voltage and the mobility, change.

This may consequently increase the differences in the unique characteristics between the driving transistors (DRT) of the subpixels, thereby causing the difference in the luminance between the subpixels to be more significant.

Such differences in the luminance between the subpixels may cause the luminance of the display panel 110 to be non-uniform, thereby significantly lowering the image quality of the display panel 110.

Accordingly, the display device 100, according to various embodiments, senses the unique characteristics of the driving transistors (DRT) of the subpixels, determines differences in the unique characteristics, and compensates for the differences in the unique characteristics.

Figure 2:
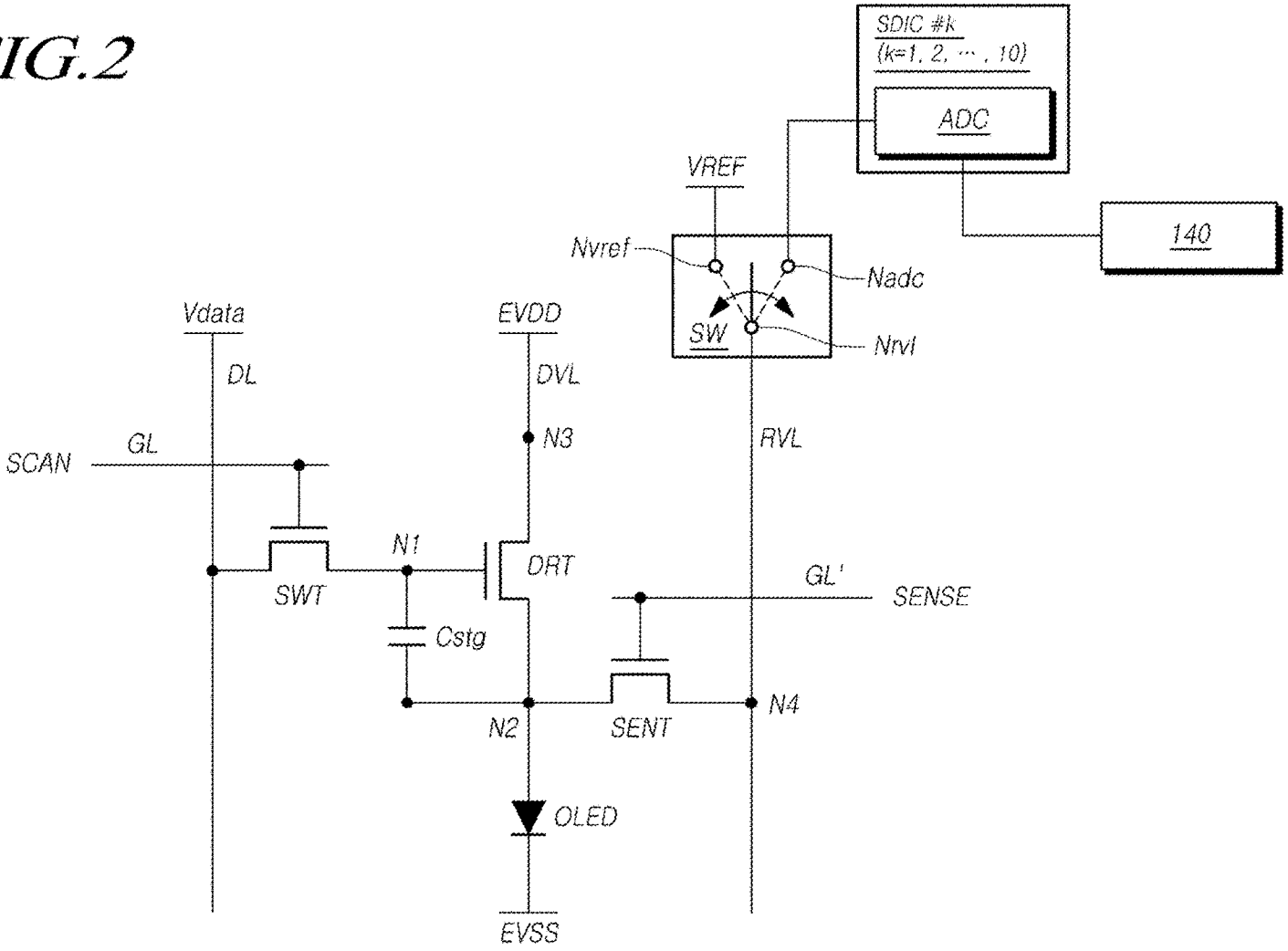
FIG. 2 illustrates an exemplary subpixel structure of the display device according to embodiments.

For the compensation for the differences in the unique characteristics, the structure of each subpixel may also be altered. FIG. 2 illustrates an exemplary subpixel structure for compensating for the differences in the unique characteristics.

A description will be given, by way of example, of a three-transistor and one-capacitor (3T1C) structure including one OLED, three transistors, and one capacitor.

FIG. 2 illustrates an exemplary subpixel structure of the display device 100 according to embodiments.

Referring to FIG. 2, each subpixel has a 3T1C structure, in which three transistors including a driving transistor DRT, a scanning transistor SWT, and a sensing transistor SENT and a single storage capacitor Cstg are provided in addition to a single OLED.

The subpixel structure illustrated in FIG. 2 is an exemplary subpixel structure to which sensing and compensation functions are applied in order to compensate for the differences in the unique characteristics (e.g. a threshold voltage and mobility) of the driving transistor DRT.

The OLED includes a first electrode (e.g. an anode or a cathode), an organic layer, and a second electrode (e.g. the cathode or the anode). The first electrode is electrically connected to a second node (N2 node) of the driving transistor DRT, and the second electrode is electrically connected to a node to which a base voltage EVSS is supplied.

Compensation for the differences in the unique characteristics of the driving transistor DRT is used as having the same meaning as compensation for the differences in the luminance of the subpixel, and is used as having the same meaning as "data compensation" since data supplied to the subpixel are changed for the luminance compensation. That is, the compensation for the differences in the unique characteristics of the driving transistor, the luminance compensation, the data compensation, and pixel compensation are used as having the same meaning.

The driving transistor DRT, a transistor driving the OLED, has a first node (N1 node) corresponding to the gate node, a second node (N2 node, for example, a source node or a drain node) electrically connected to the first electrode (e.g. the anode or a drain electrode) of the OLED, and a third node (N3 node, for example, the drain node or the source node) electrically connected to a driving voltage line DVL through which a driving voltage EVDD is supplied.

The switching transistor SWT is a transistor applying a data voltage Vdata to the N1 node corresponding to the gate node of the driving transistor DRT. The switching transistor SWT is controlled by a scanning signal SCAN applied to the gate node of the switching transistor SWT through a corresponding gate line GL, and is electrically connected between the N1 node corresponding to the gate node of the driving transistor DRT and a data line DL.

The storage capacitor Cstg is electrically connected between the N1 node and the N2 node of the driving transistor DRT, and functions to maintain a predetermined voltage for the period of a single frame.

The sensing transistor SENT is controlled by a sensing signal SENSE, a type of scanning signal, applied to the gate node from a corresponding gate line GL', and is electrically connected between a reference voltage line RVL through which a reference voltage VREF is supplied and the N2 node of the driving transistor DRT. Here, an N4 node corresponding to a drain node or a source node of the sensing transistor SENT is connected to the reference voltage line RVL, and the source node or the drain node of the sensing transistor SENT is connected to the N2 node of the driving transistor DRT.

The subpixel structure of the display device 100 further includes a switch SW connected to one side of the reference voltage line RVL and an analog-to-digital converter ADC capable of electrically connecting to the reference voltage line RVL in response to the switching operation of the switch SW.

The ADC senses a voltage at a specific node of a corresponding subpixel(s), generates sensing data by converting the sensed voltage into a digital value, and outputs the sensing data to the timing controller 140.

The use of the ADC allows information (e.g. a threshold voltage or a difference in the threshold voltage) to be sensed and the data compensation to be performed in the digital environment.

The specific node corresponding to a sensing node where the ADC senses a voltage is a node where the threshold voltage of the driving transistor DRT driving the OLED can be sensed. The specific node may be the N2 node corresponding to the source node or the drain node of the driving transistor DRT disposed in the corresponding subpixel.

This feature makes it possible to sense the unique characteristics, such as the threshold voltage or the mobility, of the driving transistor DRT driving the OLED, and a difference in the unique characteristics.

Referring to FIG. 2, the switch SW may connect a reference voltage supply node Vref or a node Nadc connected to the ADC to a node Nrvl connected to the reference voltage line RVL in response to a switching timing control signal.

When the switch SW connects the reference voltage supply node Vref to the node Nrvl connected to the reference voltage line RVL in response to the switching timing control signal, the reference voltage VREF is supplied to the reference voltage line RVL. Consequently, the reference voltage VREF is applied to the N2 node of the driving transistor DRT through the sensing transistor SENT that is turned on.

When the switch SW connects the node Nadc connected to the ADC to the node Nrvl connected to the reference voltage line RVL in response to the switching timing control signal, the ADC corresponding to a sensor can sense the voltage of the reference voltage line RVL through the reference voltage line RVL.

At this time, when the sensing transistor SENT is turned on, the ADC can sense a voltage at the N2 node of the driving transistor DRT by sensing the voltage of the reference voltage line RVL.

As above, the sensing node where the ADC senses a voltage may be the N2 node corresponding to the source node or the drain node of the driving transistor DRT.

The voltage sensed by the ADC may be expressed based on the data voltage Vdata that has been output to the drain node or the source node of the switching transistor SWT through the data line DL and subsequently applied to the N1 node of the driving transistor DRT and the threshold voltage Vth of the driving transistor DRT: the sensed voltage=Vdata−Vth.

Therefore, it is possible to determine the threshold voltage of the driving transistor DRT using the voltage Vdata−Vth sensed by the ADC and the data voltage Vdata that is already known.

The ADC performs a sensing process including sensing a voltage at the sensing node in each of the plurality of subpixels, converting the sensed voltage into a digital value, generating sensing data including the converted digital value, and transmitting the sensing data to the timing controller 140.

The use of the ADC enables the process of sensing a voltage (an analog value) at the sensing node of each subpixel, converting the sensed voltage into a digital value, and providing the converted digital value to the timing controller 140, such that the timing controller 140 can accurately sense the threshold voltage of the driving transistor DRT based on the received digital value.

The timing controller 140 receives the sensing data and determines the threshold voltage Vth of the driving transistor DRT in each subpixel based on the received sensing data, thereby obtaining a difference in the threshold voltage ΔVth.

In this case, the timing controller 140 stores the received sensing data, the determined threshold voltage, or data about the obtained difference in the threshold voltage in memory (not shown).

In order to compensate for the difference in the threshold voltage ΔVth, the timing controller 140 calculates an amount of data to be compensated ΔData for each subpixel, and stores the calculated amount of data to be compensated ΔData in the memory.

After the amount of data to be compensated ΔData for each subpixel is calculated as above, the timing controller 140 changes data to be supplied to the subpixels based on the amount of data to be compensated ΔData for each subpixel, and supplies the changed data to be supplied to the subpixels to the data driver 120. The data driver 120 converts the received data into data voltages and subsequently applies the converted data voltages to the subpixels, whereby compensation is actually carried out.

The above-stated switching timing control signal is a signal controlling the switching operation On/Off in order to set a voltage at the second node N2 of the driving transistor DRT according to the driving operation in display mode or sensing mode. The switching timing control signal can be output from the timing controller 140.

The above-stated ADC may be included in each of a plurality of source driver ICs SDIC #k (k=1, 2, . . . , 10) of the data driver 120.

As described above, the ADC corresponding to a sensing part for compensation is included in each source driver IC. Accordingly, there are advantages in that the number of parts can be reduced and the sensing operation can be performed in association with data driving.

Each reference voltage line RVL may be present in one column of subpixels or two or more columns of subpixels.

Referring to FIG. 2, the two gate lines GL and GL' through which the two scanning signals SCAN and SENSE are applied to the gate nodes of the two transistors SWT and SENT may be different gate lines or may be portions of the same gate line.

When the two gate lines GL and GL' through which the two scanning signals SCAN and SENSE are applied to the gate nodes of the two transistors SWT and SENT are different gate lines, it may be regarded that the gate line GL illustrated in FIG. 1 includes the two gate lines.

A description will be given below of a signal wiring structure between the source driver ICs SDIC #1 to SDIC #10 and the timing controller 140 of the display device 100 according to various embodiments.

The signal wiring structure between the source driver ICs SDIC #1 to SDIC #10 and the timing controller 140 of the display device 100 according to various embodiments may be provided for each group.

Considering the group shape as in FIG. 1, the display device 100 according to embodiments has the first group wiring structure corresponding to the first group G1 and the second group wiring structure corresponding to the second group G2.

Figure 3:
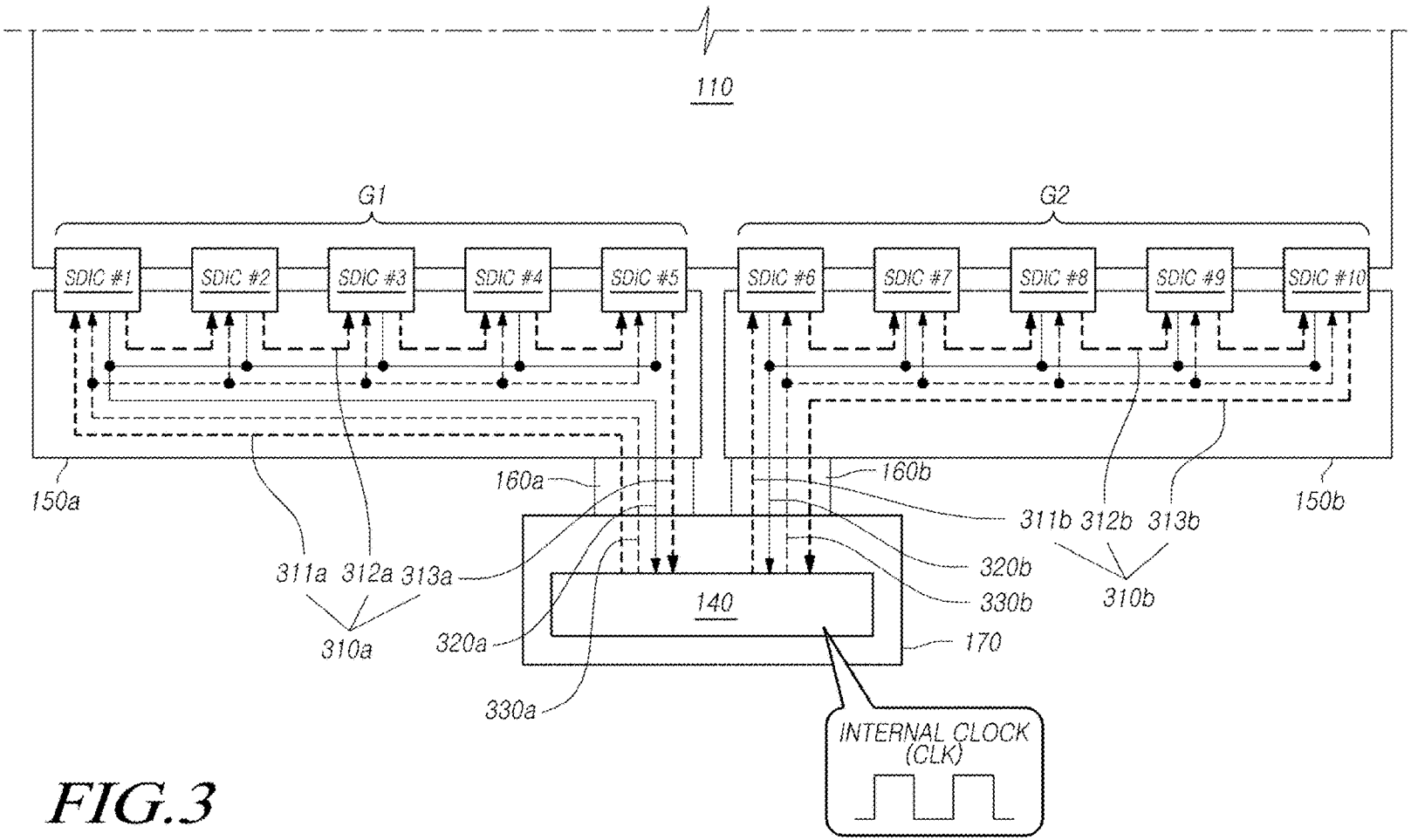
FIG. 3 is a schematic diagram illustrating an exemplary wiring structure between a plurality of source driver ICs and a timing controller in the display device according to embodiments.

FIG. 3 is a schematic diagram illustrating an exemplary wiring structure between the plurality of source driver ICs SDIC #1 to SDIC #10 and the timing controller 140 in the display device 100 according to various embodiments.

First, a description of the first wiring structure corresponding to the first group G1 will be given with reference to FIG. 3.

Referring to FIG. 3, the first group wiring structure between the five source driver ICs SDIC #1 to SDIC #5 of the first group G1 that are arranged in series and the timing controller 140 includes lock signal lines 310*a* through which a lock signal is transmitted, bus-low voltage differential signaling (B-LVDS) lines 320*a* through which data of the five source driver ICs SDIC #1 to SDIC #5 is transmitted, and image data lines 330*a* through which image data is transmitted.

In the first group wiring structure, the lock signal lines 310*a* include a first transmission line 311*a*, four cascade lines 312*a*, and a second transmission line 313*a* in order to transmit a lock signal (LOCK) in a cascade scheme. The first transmission line 311*a* connects the timing controller 140 and the first source driver IC SDIC #1 of the five source driver ICs SDIC #1 to SDIC #5 of the first group G1 that are arranged in series. The four cascade lines 312*a* connect the adjacent source driver ICs of the five source driver ICs SDIC #1 to SDIC #5. The second transmission line 313*a* connects the fifth source driver IC SDIC #5 of the five source driver ICs SDIC #1 to SDIC #5 and the timing controller 140.

The B-LVDS lines 320*a* of the first group wiring structure connect the five source driver ICs SDIC #1 to SDIC #5 of the first group G1 that are arranged in series and the timing controller 140.

The image data lines 330*a* of the first group wiring structure connect the timing controller 140 and the five source driver ICs SDIC #1 to SDIC #5 of the first group G1 that are arranged in series.

A description of the second group wiring structure corresponding to the second group will be given with reference to FIG. 3.

Referring to FIG. 3, the second group wiring structure between the five source driver ICs SDIC #6 to SDIC #10 of the second group G2 that are arranged in series and the timing controller 140 include lock signal lines 310*b* through which lock signals are transmitted, B-LVDS lines 320*b* through which data of the five source driver ICs SDIC #6 to SDIC #10 is transmitted, and image data lines 330*b* through which image data is transmitted.

In the second group wiring structure, the lock signal lines 310*b* include a first transmission line 311*b*, four cascade lines 312*b*, and a second transmission line 313*b* in order to transmit a lock signal (LOCK) in a cascade scheme. The first transmission line 311*b* connects the timing controller 140 and the first source driver IC SDIC #6 of the five source driver ICs SDIC #6 to SDIC #10 of the second group G2 that are arranged in series. The four cascade lines 312*b* connect the adjacent source driver ICs of the five source driver ICs SDIC #6 to SDIC #10. The second transmission line 313*b* connects the fifth source driver IC SDIC #10 of the five source driver ICs SDIC #6 to SDIC #10 and the timing controller 140.

The B-LVDS lines 320*b* of the second group wiring structure connect the five source driver ICs SDIC #6 to SDIC #10 of the second group G2 that are arranged in series and the timing controller 140.

The image data lines 330*b* of the second group wiring structure connect the timing controller 140 and the five source driver ICs SDIC #6 to SDIC #10 of the second group G2 that are arranged in series.

Through the above-described wiring structure, signals and/or data can be efficiently transmitted from the plurality of source driver ICs SDIC #1 to SDIC #10 to the timing controller 140 and vice versa.

The timing controller 140 of the display device 100 according to embodiments receives data from the plurality of source driver ICs SDIC #1 to SDIC #10, recognizes the received data, and performs a predetermined process.

For example, the plurality of source driver ICs SDIC #1 to SDIC #10 transmits sensing data generated by the ADC, a type of data, to the timing controller 140.

The timing controller 140 receives the sensing data from the plurality of source driver ICs SDIC #1 to SDIC #10, recognizes the received sensing data, and performs a compensation process.

The compensation process may include, for example, a process of determining the unique characteristics of the driving transistor DRT, such as the threshold voltage, or the differences in the unique characteristics in each subpixel, a process of calculating the amount of data to be compensated for each pixel based on the unique characteristics or the differences in the unique characteristics, and a process of storing the unique characteristics or the differences in the unique characteristics and the amount of data to be compensated.

The timing controller 140 recognizes data (e.g. sensing data) received from the plurality of source driver ICs SDIC #1 to SDIC #10 using an internal clock (CLK) thereof.

Figure 4:
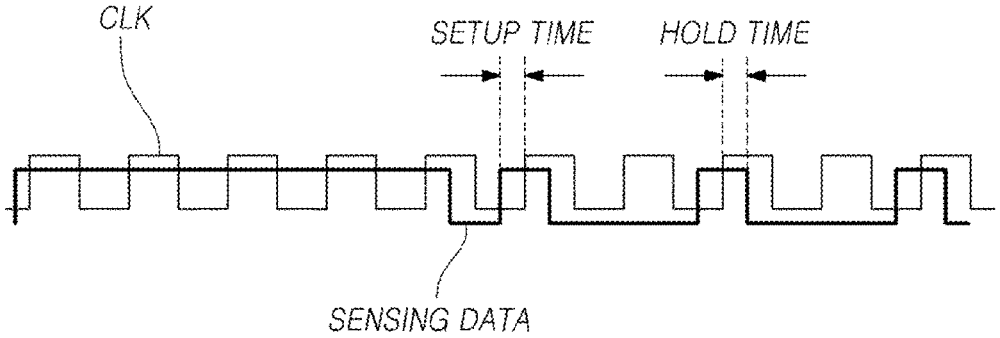
FIGS. 4 and 5 are diagrams illustrating data recognition timing in a timing controller of the display device according to embodiments.

In the recognition of the data, the timing controller 140 can accurately recognize the data (e.g. sensing data) received from the plurality of source driver ICs SDIC #1 to SDIC #10 when the data transmitted from the plurality of source driver ICs SDIC #1 to SDIC #10 is synchronous to the internal clock (CLK), as illustrated in FIG. 4.

The data transmitted from the plurality of source driver ICs SDIC #1 to SDIC #10 being synchronous to the internal clock (CLK) indicates that the sensing data is in a high-level section at a point of time when the internal clock (CLK) is changed to a high level, as illustrated in FIG. 4.

Referring to FIG. 4, in the synchronization state, a setup time corresponding to a time interval from a point when the sensing data is changed to a high level to a point when the internal clock (CLK) is changed to a high level in which the sensing data stays at the high level must be at least a predetermined period of time.

In addition, referring to FIG. 4, in the synchronization state, a hold time corresponding to a time interval from a point when the internal clock (CLK) is changed to the high level to a point when the sensing data is changed to a low level in which the sensing data stays in the high level must be at least a predetermined period of time.

Figure 5:
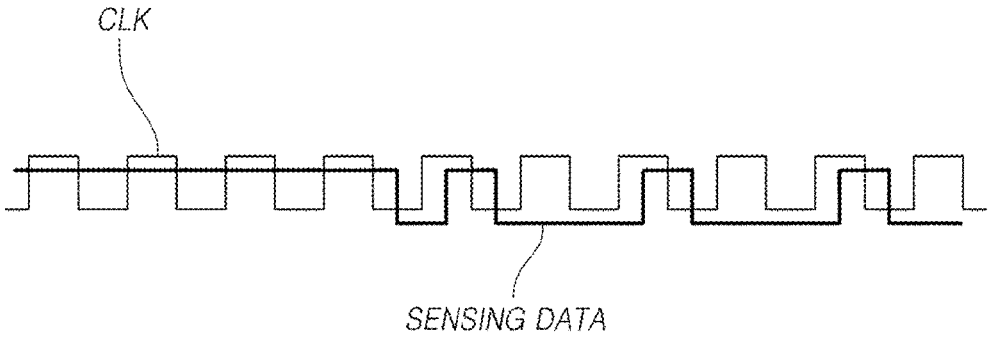

However, in the case of data recognition, data transmitted from the plurality of source driver ICs SDIC #1 to SDIC #10 may not be synchronous to the internal clock (CLK), as illustrated in FIG. 5. In this asynchronous state, the timing controller 140 cannot accurately recognize the data (e.g. the sensing data) received from the plurality of source driver ICs SDIC #1 to SDIC #10.

As illustrated in FIG. 5, in the asynchronous state, the sensing data is not in the high-level section at a point when the internal clock (CLK) is changed to the high level.

This asynchronous state occurs since each of the plurality of source driver ICs SDIC #1 to SDIC #10 transmits data (e.g. the sensing data) without a clock.

In addition, when the timing controller 140 recognizes the data (e.g. the sensing data) transmitted from each of the plurality of source driver ICs SDIC #1 to SDIC #10 using the internal clock (CLK) thereof, the data may become asynchronous to the internal clock according to external environmental factors. The external environmental factors may include, for example, the temperature, the lengths of the connection media 160*a* and 160*b*, a pattern of bus-low voltage differential signal data, and the code of the timing controller 140.

The above-described asynchronous state is also referred to as a skew phenomenon.

A description of a method of preventing the above-described asynchronous state (skew phenomenon) will be given below with reference to FIG. 6 to FIG. 8.

Figure 6:
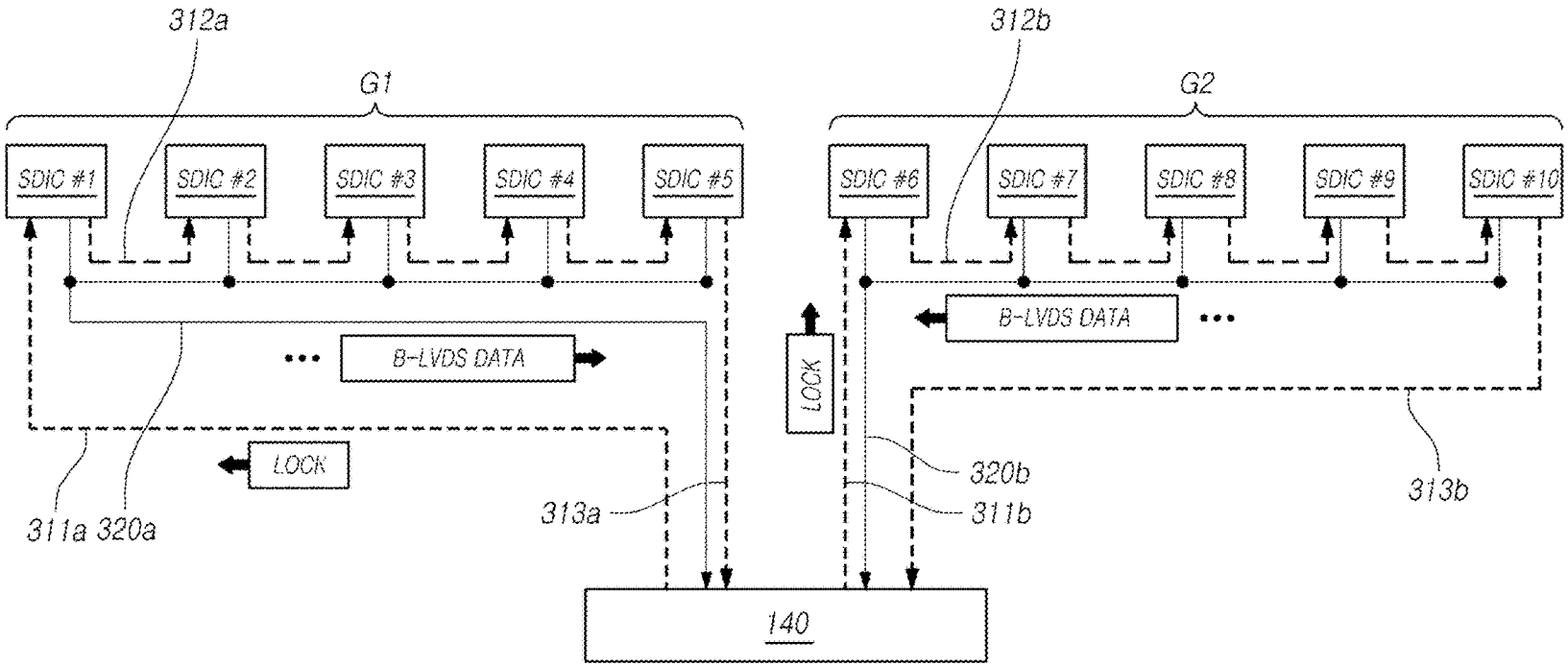
FIG. 6 illustrates the lock signals and B-LVDS data exchanged between the plurality of source driver ICs and the timing controller in the display device according to embodiments.
Figure 7:
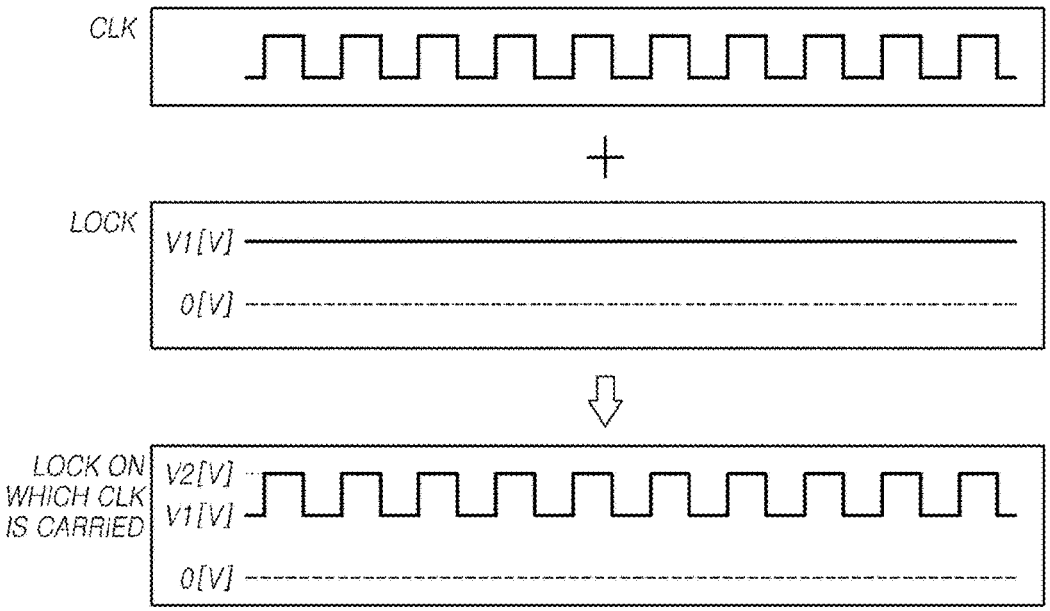
FIG. 7 illustrates a lock signal transmitted by the timing controller in the display device according to embodiments.
Figure 8:
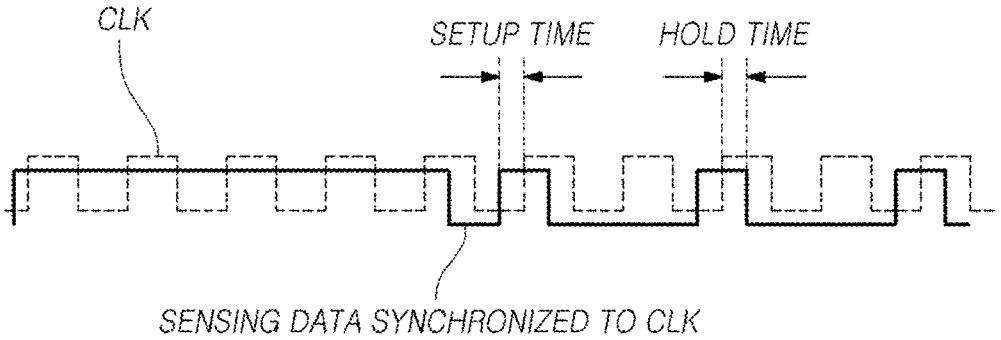
FIG. 8 illustrates sensing data transmitted by each source driver IC in the display device according to embodiments.

FIG. 6 illustrates the transmission of lock signals LOCK and B-LVDS data (sensing data) from the plurality of source driver ICs SDIC #1 to SDIC #10 to the timing controller 140 and vice versa in the display device 100 according to embodiments, FIG. 7 illustrates a lock signal transmitted by the timing controller 140 in the display device 100 according to embodiments, and FIG. 8 illustrates sensing data transmitted by each source driver IC in the display device 100 according to embodiments.

Referring to FIG. 6, when all the source driver ICs SDIC #1 to SDIC #10 of the display device 100 are divided into the two groups G1 and G2, the display device 100 has the first group wiring structure corresponding to the first group G1 and the second group wiring structure corresponding to the second group G2. If the source driver ICs SDIC #1 to SDIC #10 of the display device 100 are not grouped, i.e. all the source driver ICs SDIC #1 to SDIC #10 belong to a single group, the display device 100 has a single wiring structure (identical to the first wiring structure or the second wiring structure).

Referring to FIG. 6, the first group wiring structure corresponding to the first group G1 including the five source driver ICs SDIC #1 to SDIC #5 from the left includes lock signal lines 310*a* through which lock signals are transmitted, B-LVDS lines 320*a* through which the B-LVDS data (e.g. sensing data) of the five source driver ICs SDIC #1 to SDIC #5 is transmitted, and the like.

In the first group wiring structure, the lock signal lines 310*a* include the first transmission line 311*a*, the four cascade lines 312*a*, and the second transmission line 313*b* in order to transmit a lock signal LOCK on which an internal clock is added in a cascade scheme. The first transmission line 311*a* connects the timing controller 140 and the first source driver IC SDIC #1 of the five source driver ICs SDIC #1 to SDIC #5 of the first group G1 that are arranged in series. The four cascade lines 312*a* connect the adjacent source driver ICs of the five source driver ICs SDIC #1 to SDIC #5. The second transmission line 313*b* connects the fifth source driver IC SDIC #5 of the five source driver ICs SDIC #1 to SDIC #5 and the timing controller 140.

The B-LVDS lines 320*a* of the first group wiring structure connect the five source driver ICs SDIC #1 to SDIC #5 of the first group G1 that are arranged in series and the timing controller 140 in order to transmit the data (B-LVDS data) synchronized to the internal clock CLK.

Although not shown in FIG. 6, in order to transmit image data, the image data lines 330*a* of the first group wiring structure connect the adjacent source driver ICs of the five source driver ICs SDIC #1 to SDIC #5 of the first group G1 that are arranged in series in the same manner as in FIG. 3.

Referring to FIG. 6, the second group wiring structure corresponding to the second group G2 including the five source driver ICs SDIC #6 to SDIC #10 except for the five source driver ICs SDIC #1 to SDIC #5 of the first group G1 includes the lock signal lines 310*b* through which lock signals are transmitted, the B-LVDS lines 320*b* through which the B-LVDS data (e.g. sensing data) of the five source driver ICs SDIC #6 to SDIC #10 is transmitted, and the like.

In the second group wiring structure, the lock signal lines 310*b* include the first transmission line 311*b*, the four cascade lines 312*b*, and the second transmission line 313*b* in order to transmit a lock signal (LOCK) in a cascade scheme. The first transmission line 311*b* connects the timing controller 140 and the first source driver IC SDIC #6 of the five source driver ICs SDIC #6 to SDIC #10 of the second group G2 that are arranged in series. The four cascade lines 312*b* connect the adjacent source driver ICs of the five source driver ICs SDIC #6 to SDIC #10. The second transmission line 313*b* connects the fifth source driver IC SDIC #10 of the five source driver ICs SDIC #6 to SDIC #10 and the timing controller 140.

The B-LVDS lines 320*b* of the second group wiring structure connect the five source driver ICs SDIC #6 to SDIC #10 of the second group G2 that are arranged in series and the timing controller 140.

Although not shown in FIG. 6, in order to transmit image data, the image data lines 330*b* of the second group wiring structure connect the adjacent source driver ICs of the five source driver ICs SDIC #6 to SDIC #10 of the second group G2 that are arranged in series in the same manner as in FIG. 3.

Referring to FIG. 6 and FIG. 7, the timing controller 140 transmits the internal clock CLK in the shape of a square wave having a predetermined frequency by carrying the internal clock CLK on the lock signal LOCK through the first transmission line 311*a* of the lock signal lines 310*a* corresponding to the first group G1 and the first transmission line 311*b* of the lock signal lines 310*b* corresponding to the second group G2.

Referring to FIG. 6 and FIG. 7, the first source driver IC SDIC #1 in the first group G1 receives the lock signal LCK carrying the internal clock CLK from the timing controller 140, and in the case of a normal state (e.g. a state in which a data voltage can be normally output), outputs the lock signal LCK carrying the internal clock CLK in a high level to the next source driver IC SDIC #2 through the first cascade line of the cascade lines 312*a*. When all the next source driver IC SDIC #2 and the remaining source driver ICs SDIC #3, SDIC #4, and SDIC #5 are in the normal state, the lock signal LCK carrying the internal clock CLK is transmitted in the high level through the second to fourth cascade lines of the cascade lines 312*a* and the second transmission line 313*b*.

Referring to FIG. 6 and FIG. 7, the first source driver IC SDIC #1 of the first group G1 receives the lock signal LCK carrying the internal clock CLK from the timing controller 140, and in the case of an abnormal state (e.g. a state in which a data voltage cannot be normally output), outputs the lock signal LCK carrying the internal clock CLK in a low level to the next source driver IC SDIC #2 through the first cascade line of the cascade lines 312*a*. The signal LCK carrying the internal clock CLK is transmitted in the low level to the timing controller 140 through the next source driver IC SDIC #2 and the remaining source driver ICs SDIC #3, SDIC #4, and SDIC #5.

Referring to FIG. 6 and FIG. 7, in response to the lock signal LOCK carrying the internal clock CLK being input, each of the five source driver ICs SDIC #1 to SDIC #5 synchronizes the data (B-LVDS data) to the internal clock CLK carried on (or superimposed on) the lock signal LOCK and transmits the data (B-LVDS data) synchronized to the internal clock CLK to the timing controller 140 through the B-LVDS lines 320*a*.

In the second group G2, the timing controller 140 transmits a lock signal LOCK carrying an internal clock CLK, which can be in turn transmitted through the five source driver ICs SDIC #6 to SDIC #10 to the timing controller 140 in the same cascade scheme as in the first group G1.

In the same manner as in the first group G1, B-LVDS data (sensing data) synchronized to the internal clock CLK carried on the lock signal LOCK can be transmitted from each of the five source driver ICs SDIC #6 to SDIC #10 of the second group G2 to the timing controller 140.

Since the timing controller 140 transmits the internal clock CLK on the lock signal LOCK as described above, each of the plurality of source driver ICs SDIC #1 to SDIC #10 can transmit the B-LVDS data by synchronizing the B-LVDS data to the internal clock CLK known to the timing controller 140. This can consequently prevent data recognition errors from being caused by the asynchronous state (skew phenomenon) in the timing controller 140. It is therefore possible to prevent the following process from being erroneously performed due to a data recognition error caused by the asynchronous state (skew phenomenon).

The data synchronized to the internal clock CLK carried on the lock signal LOCK from each of the plurality of source driver ICs SDIC #1 to SDIC #10 may be data sensed from the corresponding subpixel by the ADC included inside the subpixel.

It is therefore possible to prevent the sensing data from being erroneously recognized due to the asynchronous state (skew phenomenon). This can consequently prevent the unique characteristics of the driving transistor DRT within the corresponding subpixel or the differences in the unique characteristics from being erroneously determined or an amount of data to be compensated from being erroneously calculated due to a sensing data recognition error, thereby improving image quality.

Referring to FIG. 6 and FIG. 8, the timing controller 140 receives the sensing data, i.e., data synchronized to the internal clock CLK, from each of the plurality of source driver ICs SDIC #1 to SDIC #10, and receives the lock signal LOCK carrying the internal clock CLK from at least one of the plurality of source driver ICs SDIC #1 to SDIC #10 (e.g., the last source driver IC when the plurality of source driver ICs is not grouped, or the source driver ICs SDIC #5 and SDIC #10 when the plurality of source driver ICs is divided into the two groups). Afterwards, the timing controller 140 recognizes the received sensing data by synchronizing received sensing data to the internal clock CLK carried on the received lock signal LOCK, and performs a compensation process to compensate for the luminance of the corresponding subpixel based on the recognized sensing data.

The compensation process may include, for example, the process of determining the unique characteristics of the driving transistor DRT, such as the threshold voltage, or the differences in the unique characteristics in each subpixel, the process of calculating the amount of data to be compensated for each pixel based on the determined unique characteristics or the determined differences in the unique characteristics, and the process of storing the unique characteristics or the differences in the unique characteristics and the amount of data to be compensated.

As described above, the timing controller 140 receives the sensing data synchronized to the internal clock CLK from each of the plurality of source driver ICs SDIC #1 to SDIC #10, and recognizes the sensing data using the internal clock CLK (the clock to which the received sensing data is synchronized) carried on the lock signal LOCK. Consequently, the timing controller 140 can prevent the asynchronous state (the skew phenomenon) between the clock and the sensing data, thereby preventing the sensing data from being erroneously recognized. Accordingly, the timing controller 140 can accurately recognize the unique characteristics of the driving transistor DRT in each subpixel and the differences in the unique characteristics and accurately calculate the amount of data to be compensated, thereby improving image quality.

As described above, the timing controller 140 and the source driver ICs SDIC #k (k=1, 2, . . . , 10) provide a signal transmission method for preventing an asynchronous state between data and a clock. The timing controller and the source driver ICs will be described again below.

Figure 9A:
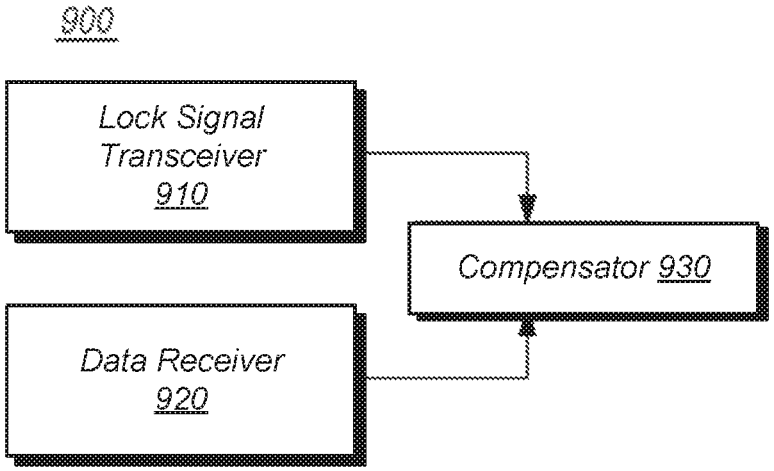
FIG. 9A is a block diagram illustrating a controller of the display device according to embodiments.
Figure 9B:
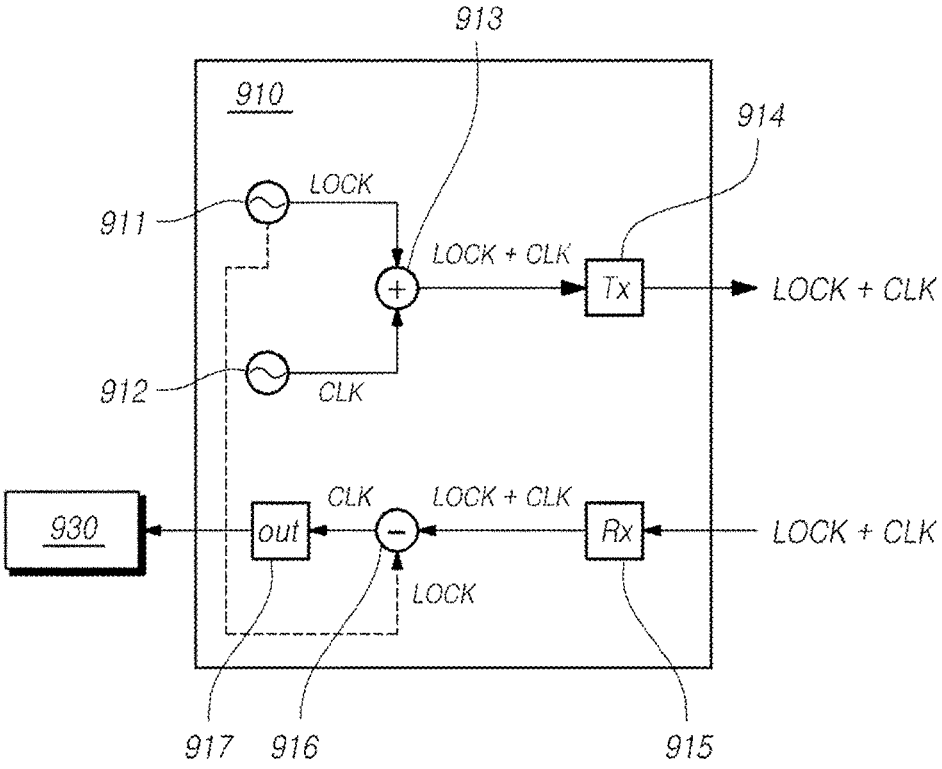
FIG. 9B illustrates an internal configuration diagram of a lock signal transceiver of the controller.

FIG. 9A is a block diagram illustrating a controller 900 of the display device 100 according to embodiments, and FIG. 9B illustrates an internal configuration diagram of a lock signal transceiver 910 of the controller 900.

Referring to FIG. 9A, the controller 900 of the display device 100 according to embodiments includes the lock signal transceiver 910 transmitting and receiving a lock signal LOCK carrying an internal clock CLK and a data receiver 920 receiving data synchronized to the internal clock CLK.

As described above, the controller 900 transmits the lock signal LOCK by carrying the internal clock CLK on the lock signal LOCK. Thus, the source driver ICs SDIC #k can transmit B-LVDS data synchronous to the internal clock CLK that is used for the recognition of the B-LVDS data. Accordingly, the timing controller 140 can accurately recognize the B-LVDS data since no asynchronous state (no skew phenomenon) occurs between the internal clock CLK and the B-LVDS data.

Referring to FIG. 9A, the controller 900 of the display device 100 according to embodiments further includes a compensator 930. When the lock signal transceiver 910 receives the lock signal LOCK carrying the internal clock CLK and the data receiver 920 receives the data corresponding to the sensing data synchronous to the internal clock CLK, the compensator 930 recognizes the sensing data by synchronizing the sensing data to the internal clock CLK carried on the received lock signal LOCK, and performs a compensation process based on the recognized sensing data.

Since the sensing data corresponding to the B-LVDS is received in the state synchronized to the internal clock CLK as described above, the controller 900 can accurately recognize the sensing data. It is therefore possible to accurately perform the compensation process using the sensing data recognition result, thereby improving image quality.

Referring to FIG. 9B, the lock signal transceiver 910 includes a lock signal generator 911 generating a lock signal LOCK, a clock generator 912 generating an internal clock CLK based on stored internal clock information, a signal processor 913 generating the lock signal LOCK carrying the internal clock CLK by coupling the lock signal LOCK generated by the lock signal generator 911 and the internal clock CLK generated by the clock generator 912, and a lock signal transmitter 914 transmitting the lock signal generated by the signal processor 913.

In addition, referring to FIG. 9B, the lock signal transceiver 910 further includes a lock signal receiver 915 receiving a lock signal LOCK carrying an internal clock CLK, a clock extractor 916 extracting the internal clock CLK from the lock signal LOCK received by the lock signal receiver 915, and a lock signal output section 917 outputting the internal clock CLK extracted by the clock extractor 916 to the compensator 930.

In addition, the controller 900 schematically illustrated in FIG. 9A may be the timing controller 140 described herein. Alternatively, one or two components of the lock signal transceiver 910, the data receiver 920, and the compensator 930 of the controller 900 may be embodied in the timing controller 140, and the remaining two or one component may be embodied in a separate controller.

Figure 10:
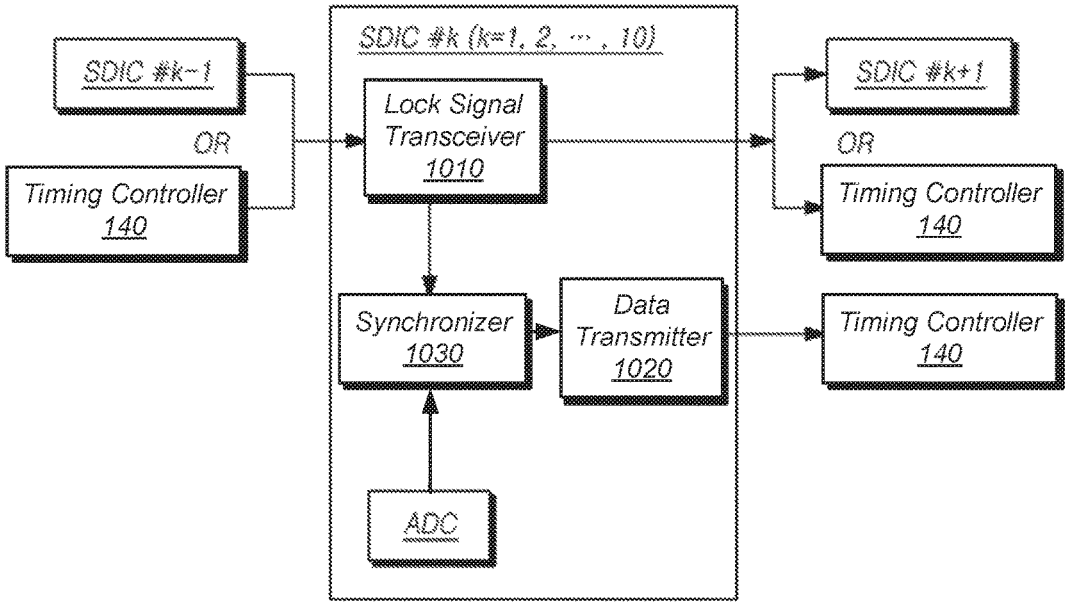
FIG. 10 is an exemplary block diagram of the source driver IC of the display device according to embodiments.

FIG. 10 is an exemplary block diagram of the source driver IC SDIC #k (k=1, 2, . . . , 10) of the display device 100 according to various embodiments.

Referring to FIG. 10, the source driver IC SDIC #k (k is one of 1, 2, . . . , and 10) of the display device 100 according to various embodiments includes a lock signal transceiver 1010 and a data transmitter 1020. The lock signal transceiver 1010 receives a lock signal LOCK carrying an internal clock CLK from the previous source driver IC SDIC #k−1 or the timing controller 140, and when specific conditions (e.g., a normal state) are satisfied, outputs the lock signal LOCK to the next source driver IC SDIC #k+1 or the timing controller 140. The data transmitter 1020 transmits data (e.g. sensing data) synchronized to the internal clock CLK carried on the lock signal LOCK to the timing controller 140 through the B-LVDS lines 320*a* and 320*b*.

As described above, the source driver IC SDIC #k receives the lock signal LOCK carrying the internal clock CLK, and transmits the B-LVDS data synchronized to the internal clock CLK carried on the received lock signal LOCK. Accordingly, when the timing controller 140 recognizes the B-LVDS data, no asynchronous state (no skew phenomenon) occurs, whereby the data can be accurately recognized.

Referring to FIG. 10, the source driver IC SDIC #k (k is one of 1, 2, . . . , and 10) of the display device 100 according to various embodiments further includes an ADC and a synchronizer 1030. The ADC senses a voltage at a specific node in a corresponding subpixel on the display panel 110 and outputs sensing data by converting the sensed voltage into a digital value. The synchronizer 1030 synchronizes the sensing data generated by the ADC to the internal clock CLK carried on the lock signal LOCK received by the lock signal transceiver 1010.

Referring to FIG. 10, the data transmitter 1020 transmits the sensing data to the timing controller 140, the sensing data being synchronized to the internal clock CLK carried on the lock signal LOCK by the synchronizer 1030.

Since the source driver IC SDIC #k transmits the sensing data corresponding to the B-LVDS data by synchronizing the sensing data to the internal clock CLK carried on the received lock signal LOCK as described above, when the timing controller 140 recognizes the sensing data corresponding to the B-LVDS data, no asynchronous state (no skew phenomenon) occurs, whereby the sensing data can be accurately recognized. Accordingly, the compensation process using the result of the recognition of the sensing data can be accurately performed, thereby improving image quality.

Figure 11:
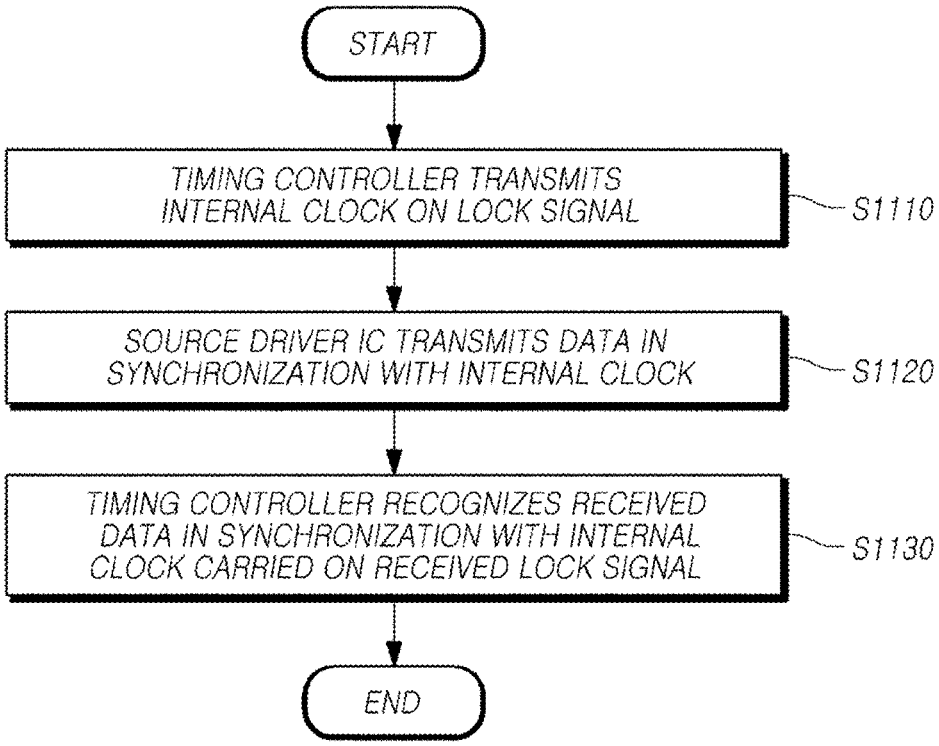
FIG. 11 is a flowchart illustrating a signal transmission method of the display device according to embodiments.

FIG. 11 is a flowchart illustrating a signal transmission method of the display device 100 according to various embodiments.

Referring to FIG. 11, in the display device 100 including the display panel 110 on which the data lines and the gate lines are disposed, the source driver IC SDIC #k (k is one of 1, 2, . . . , and 10) driving the data lines, and the timing controller 140 controlling the source driver IC SDIC #k, the signal transmission method of the display device 100 includes: step S1110 of transmitting, at the timing controller 140, an internal clock CLK by carrying the internal clock CLK on a lock signal LOCK; step S1120 of transmitting, at the source driver IC SDIC #k, data to the timing controller 140 by synchronizing the data to the internal clock CLK carried on the lock signal LOCK; and step S1130 of receiving, at the timing controller 140, the lock signal LOCK carrying the internal clock CLK, and when the data synchronized to the internal clock CLK carried on the lock signal LOCK is received, recognizing the received data by synchronizing the received data to the internal clock CLK carried on the received lock signal LOCK.

According to the above-described signal transmission method, since the timing controller 140 transmits the internal clock CLK by carrying the internal clock CLK on the lock signal LOCK, each of the plurality of source driver ICs SDIC #1 to SDIC #10 can transmit the B-LVDS data synchronized to the internal clock CLK. When the timing controller 140 recognizes the B-LVDS data, no asynchronous state (no skew phenomenon) occurs between the internal clock CLK and the B-LVDS data, whereby the data can be accurately recognized.

According to the embodiments as set forth above, it is possible to provide the timing controller 140, the source driver IC SDIC #k, the display device 100, and the signal transmission method thereof able to prevent data recognition errors that would otherwise be caused by the asynchronous state between the internal clock CLK and the B-LVDS data.

The foregoing descriptions and the accompanying drawings have been presented in order to explain the certain principles of the present invention. A person skilled in the art to which the invention relates can make many modifications and variations by combining, dividing, substituting for, or changing the elements without departing from the principle of the invention. The foregoing embodiments disclosed herein shall be interpreted as illustrative only but not as limitative of the principle and scope of the invention. It should be understood that the scope of the invention shall be defined by the appended Claims and all of their equivalents fall within the scope of the invention.

What is claimed is:

1. A display device comprising:

a display panel on which a plurality of subpixels are disposed;

a timing controller configured to transmit an internal clock on a lock signal, and to transmit an image data separately from the internal clock; and a plurality of source driver integrated circuits configured to transmit a sensing data synchronized to the internal clock to the timing controller in response to receiving the lock signal carrying the internal clock, wherein the lock signal is transmitted from the timing controller to one source driver of the plurality of source driver integrated circuits and the lock signal received from the timing controller by the one source driver is transmitted sequentially from the one source driver to other source drivers of the plurality of source driver integrated circuits arranged in series, wherein the timing controller is configured to:

receive the sensing data synchronized to the internal clock from each of the plurality of source driver integrated circuits;

receive the lock signal carrying the internal clock from at least one source driver integrated circuit of the plurality of source driver integrated circuits;

recognize the sensing data by synchronizing the sensing data to the internal clock carried on the lock signal; and compensate for a corresponding subpixel of the plurality of subpixels based on the sensing data.

2. The display device according to claim 1, wherein each of the plurality of source driver integrated circuits comprises an analog-to-digital converter sensing a voltage at a node in the corresponding subpixel of the plurality of subpixels and outputting the sensing data by converting the sensed voltage into a digital value.

3. The display device according to claim 2, wherein the node comprises a source node or a drain node of a driving transistor driving an organic light-emitting diode disposed on the corresponding subpixel.

4. The display device according to claim 2, wherein each of the plurality of subpixels includes a switch between the node for the sensed voltage and another node for a reference voltage.

5. The display device according to claim 1, wherein the timing controller comprises:

lock signal lines through which the lock signal carrying the internal clock is transmitted, wherein the lock signal lines include a first transmission line connecting the timing controller and the one source driver, cascade lines connecting the other source drivers, and a second transmission line connecting a last source driver integrated circuit of the plurality of source driver integrated circuits and the timing controller; and bus-low voltage differential signaling lines connecting the plurality of source driver integrated circuits and the timing controller in order to transmit the sensing data synchronized to the internal clock.

6. A source driver integrated circuit comprising:

a lock signal transceiver configured to receive, from a timing controller, a lock signal carrying an internal clock, and to output the lock signal, the source driver integrated circuit configured to transmit an image data separately from the internal clock; and a data transceiver configured to transmit a sensing data synchronized to the internal clock carried on the lock signal, wherein the lock signal received from the timing controller by the source driver integrated circuit is transmitted sequentially from the source driver integrated circuit to a plurality of source driver integrated circuits arranged in series, wherein the timing controller is configured to:

receive the sensing data synchronized to the internal clock from each of the plurality of source driver integrated circuits;

receive the lock signal carrying the internal clock from at least one source driver integrated circuit of the plurality of source driver integrated circuits;

recognize the sensing data by synchronizing the sensing data to the internal clock carried on the lock signal; and compensate for a corresponding subpixel of a plurality of subpixels on a display panel based on the sensing data.

7. The source driver integrated circuit according to claim 6, further comprising:

an analog-to-digital converter configured to sense a voltage at a node in the corresponding subpixel of the plurality of subpixels on the display panel and to output the sensing data by converting the sensed voltage into a digital value; and a synchronizer configured to synchronize the sensing data to the internal clock carried on the lock signal.

8. A signal transmission method of a display device including a display panel on which data lines, gate lines, and a plurality of subpixels are disposed, a source driver integrated circuit driving the data lines, and a timing controller controlling the source driver integrated circuit, the method comprising:

transmitting, at the timing controller, an internal clock on a lock signal to the source driver integrated circuit;

transmitting the lock signal received from the timing controller by the source driver integrated circuit sequentially from the source driver integrated circuit to a plurality of source driver integrated circuits arranged in series;

transmitting, at the source driver integrated circuit, sensing data to the timing controller by synchronizing the sensing data to the internal clock carried on the lock signal;

receiving, at the timing controller, the sensing data synchronized to the internal clock from each of the plurality of source driver integrated circuits;

receiving, at the timing controller, the lock signal carrying the internal clock from at least one source driver integrated circuit of the plurality of source driver integrated circuits;

recognizing, by the timing controller, the sensing data by synchronizing the sensing data to the internal clock carried on the lock signal;

compensating, by the timing controller, for a corresponding subpixel of the plurality of subpixels based on the sensing data; and transmitting, by the timing controller, image data separately from the internal clock.

9. The signal transmission method of claim 8, wherein the source driver integrated circuit generates the sensing data by sensing a voltage at a node in the corresponding subpixel of the display panel.

* * * * *